US006746291B1

(12) United States Patent
Coleman et al.

(10) Patent No.: US 6,746,291 B1
(45) Date of Patent: Jun. 8, 2004

(54) HYBRID INFLATABLE AND RIGID SHORELINE RIDING TOY

(76) Inventors: Kenneth Coleman, 8200 Redlands St., Apt. 107, Playa del Rey, CA (US) 90293; Brandon Coleman, 8200 Redlands St., Apt. 107, Playa del Rey, CA (US) 90293

( * ) Notice: Subject to any disclaimer, the term of this patent is extended or adjusted under 35 U.S.C. 154(b) by 0 days.

(21) Appl. No.: 10/291,347

(22) Filed: Nov. 8, 2002

Related U.S. Application Data

(60) Provisional application No. 60/387,653, filed on Jun. 11, 2002, and provisional application No. 60/387,655, filed on Jun. 11, 2002.

(51) Int. Cl.[7] ..... B63B 35/76

(52) U.S. Cl. ..... 441/65; 441/129; 472/14; 280/18.1

(58) Field of Search ..... 441/65–67, 129, 441/131; 114/346; 280/18.1; 472/14

(56) References Cited

U.S. PATENT DOCUMENTS 3,176,999 A * 4/1965 Atcherley, Jr. ..... 280/18
3,628,206 A * 12/1971 Mecham ..... 280/18.1
3,871,042 A * 3/1975 Farmer ..... 114/346

* cited by examiner

*Primary Examiner*—Jesus D. Sotelo
(74) *Attorney, Agent, or Firm*—Goldstein Law Offices, P.C.

(57) ABSTRACT

A shoreline riding toy, for use in hydroplaning along a thin layer of water at a shoreline, having a rigid lower board having a hard and slick bottom surface, and a soft, inflatable upper portion. The upper portion is adhered to the lower board. The upper portion overhangs the lower board in all horizontal directions. The upper portion supports the user such that when the user runs and dives while holding the toy to initiate hydroplaning of the lower board on the thin layer of water, the upper portion suspends the user above the lower board for the comfort and safety of the user.

11 Claims, 5 Drawing Sheets

HYBRID INFLATABLE AND RIGID SHORELINE RIDING TOY

CROSS REFERENCES AND RELATED SUBJECT MATTER

This Application is a continuation-in-part of Provisional Patent Application Serial Nos. 60/387,653 and 60/387,655, filed in the United States Patent Office on Jun. 11, 2002.

BACKGROUND-OF THE INVENTION

The invention relates to a hybrid inflatable and rigid shoreline riding toy. More particularly, the invention relates to a device which has a rigid bottom to facilitate hydroplaning across a thin layer of water left behind by breaking waves at the shoreline, and has a soft, inflatable upper portion to ensure comfort and safety to riders of all ages.

People searching for enhanced enjoyment at the beach often seek two classes of devices: surf boards and inflatable toys. Surf boards are typically rigid devices which have a smooth yet rigid surface which allows them to maintain a profile that is capable of moving rapidly through the water. Inflatable toys are typically deformable devices made of a flexible membrane which contains a quantity of air that makes them buoyant and absorbs a great deal of external forces which smoothes the experience for the user. Accordingly, surf boards are typically used by adults and older, more responsible children, and inflatable toys are typically used by younger children and those seeking a safer, although less exciting experience.

A variety of water vehicles and toys have been developed for enjoyment of the water. For example, U.S. Pat. No. 3,045,264 to Smith discloses a water sled. Smith is intended to be pulled by a towing rope, provides a rigid lower surface to facilitate hydroplaning and has a rigid cavity for the rider. However, since Smith is designed for use across open water, Smith does little to cushion the user. Accordingly, Smith would not be suitable for use in hydroplaning on the beach.

U.S. Pat. No. 5,702,28 to Boucher and U.S. Pat. No. 6,220,908 to Peterson both disclose inflatable towable vehicles. These devices are comprised of inflatable chambers which skip across the water surface when towed by a watercraft. U.S. Pat. No. 5,279,510 discloses a towable riding device which includes a flexible cushion which is placed beneath and between an inflatable ring.

U.S. Pat. No. 5,101,752 to Smollar et al. Discloses a body board which is made of multiple inflatable chambers. Smollar is designed for use on a water slide, and accordingly must conform to the curvature of the slide. Accordingly, Smollar does not provide a rigid bottom portion and thus is not suitable for hydroplaning on the beach.

U.S. Pat. No. 3,581,328 to Smith discloses a water sports vehicle which includes a body portion which is made of a rigid material such as plywood, fiberglass and metal. Smith includes an inflated cushion which attaches above the body to serve as a cushion and seat. However, since Smith is intended to be towed, the body projects outward from all sides. Accordingly, Smith would be hazardous to the user and would be downright dangerous for use when hydroplaning on the beach when other bathers are also enjoying the surf.

While these units may be suitable for the particular purpose employed, or for general use, they would not be as suitable for the purposes of the present invention as disclosed hereafter.

SUMMARY OF THE INVENTION

It is an object of the invention to produce a shoreline riding toy which allows a user to glide across the shoreline on the thin layer of water left behind by breaking waves. Accordingly, the riding toy has a rigid lower board having a slick bottom surface which facilitates hydroplaning across very shallow water.

It is a further object of the invention to provide a shoreline riding toy which is comfortable to the user, and allows the user to safely run and dive upon the wet sand at the shoreline using the toy. Accordingly, a soft, inflatable upper portion cushions to user so that they can safely dive onto the hard sand to enjoy a hydroplaning ride across the sand. The inflatable cushion has a central recess which helps keep the user on the riding toy yet keeps the user raised above the rigid lower board.

It is a still further object of the invention to provide a shoreline riding toy which is safe for the user and which prevents injury to other bathers at the beach. Accordingly, the inflatable upper portion fully overlaps the rigid lower board such that any collision with the riding toy will be with the soft, inflatable upper portion. In addition, handles are located on the inflatable portion to both facilitate the "running and diving" use of the riding toy and to minimize contact by the user with the lower board.

The invention is a shoreline riding toy, for use in hydroplaning along a thin layer of water at a shoreline, having a rigid lower board having a hard and slick bottom surface, and a soft, inflatable upper portion. The upper portion is adhered to the lower board. The upper portion overhangs the lower board in all horizontal directions. The upper portion supports the user such that when the user runs and dives while holding the toy to initiate hydroplaning of the lower board on the thin layer of water, the upper portion suspends the user above the lower board for the comfort and safety of the user.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
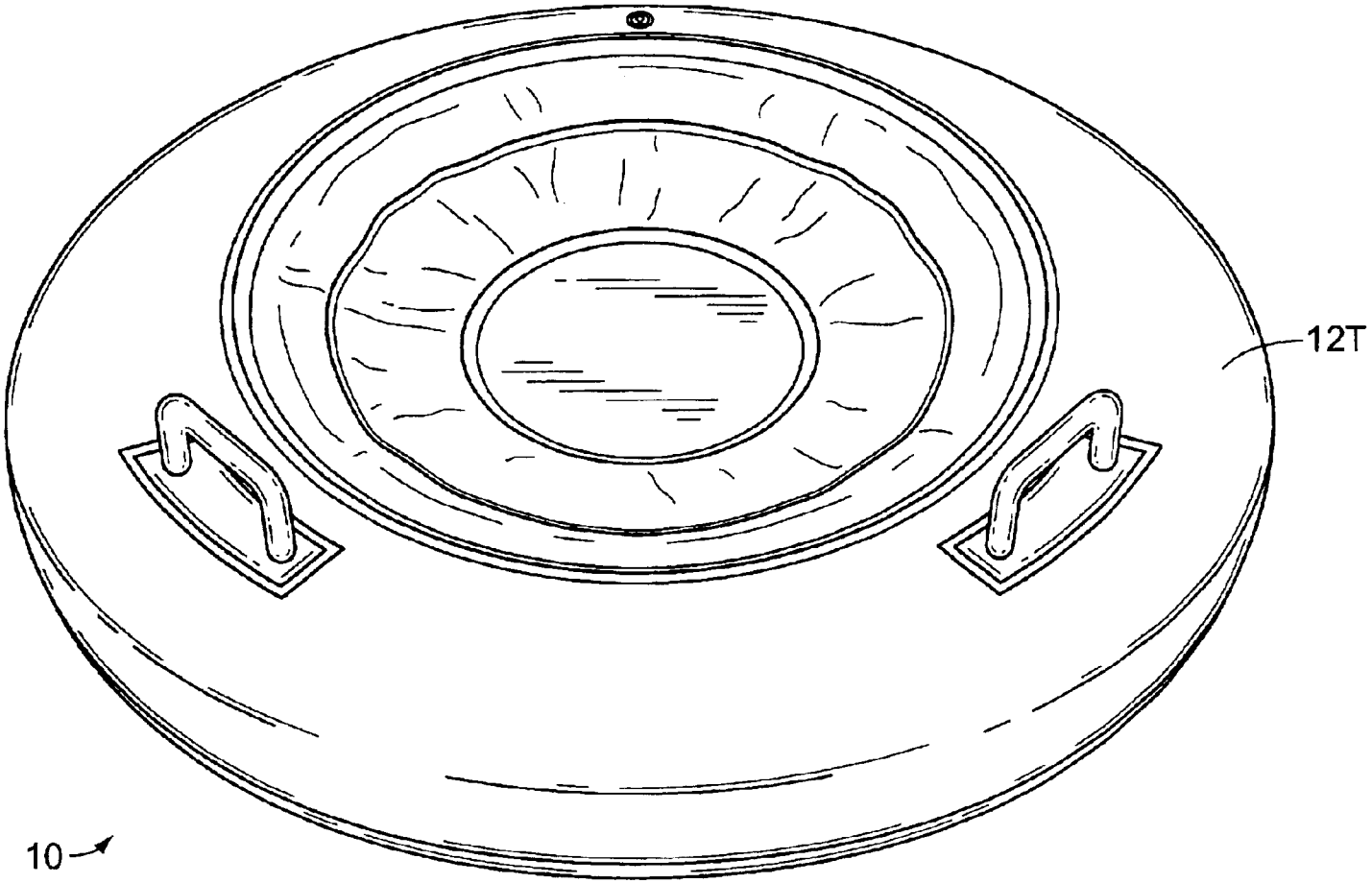
FIG. 1 is a diagrammatic perspective view, illustrating a first embodiment of the toy, per se, showing the upper portion having handles located on a top surface thereof.
Figure 2:
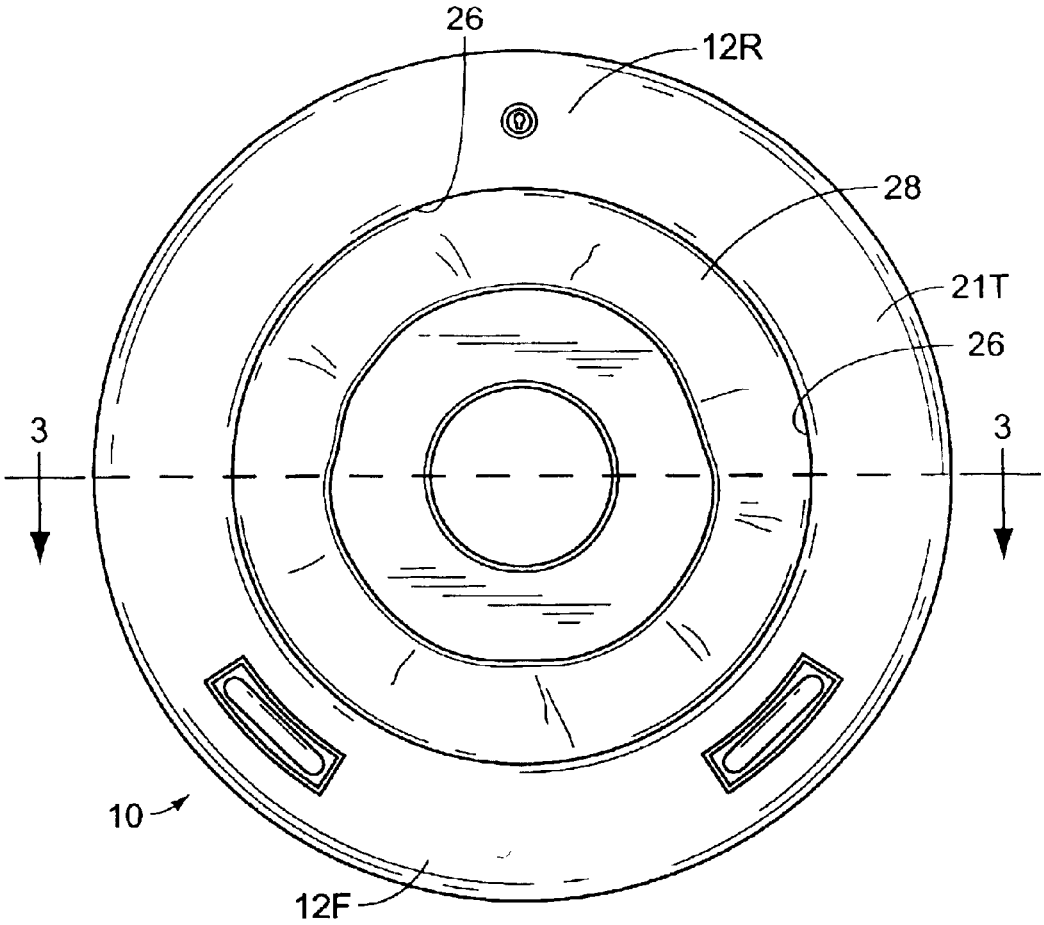
FIG. 2 is a top plan view thereof.
Figure 5:
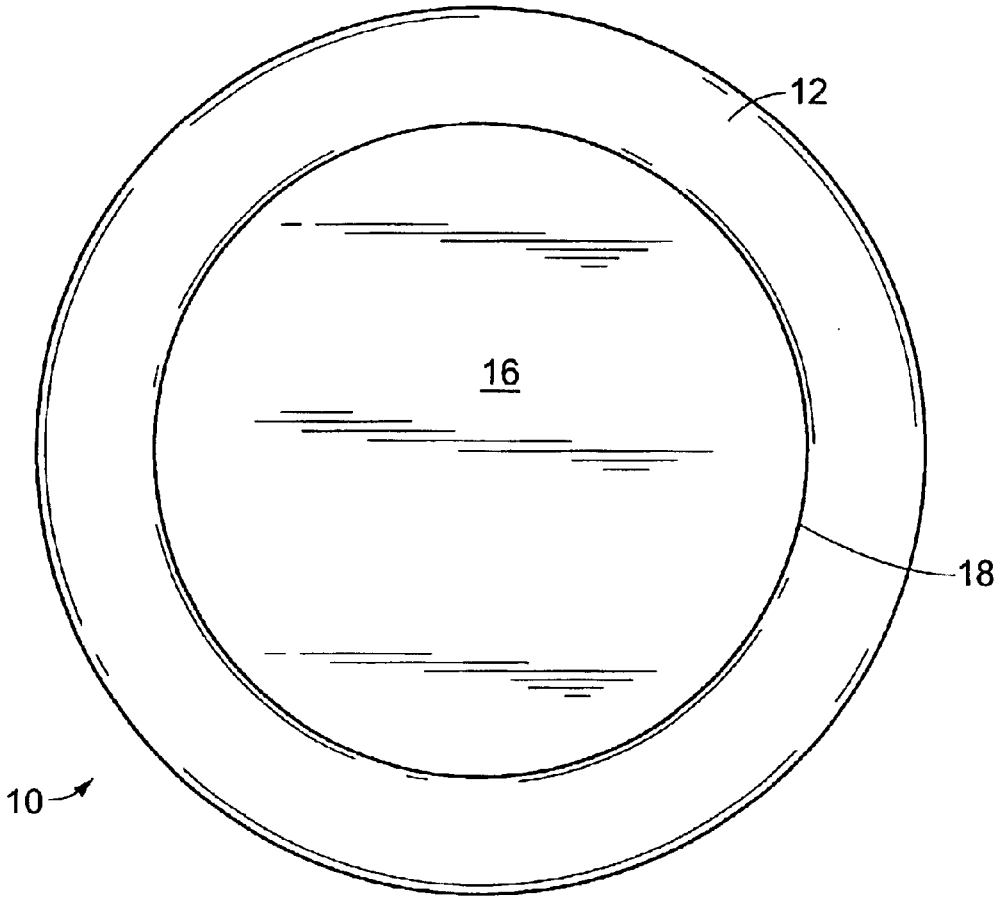
FIG. 5 is a bottom elevational view thereof.

FIGS. 1 through 6 illustrate a first embodiment of a shoreline sliding toy 10 having an upper portion 12 and a lower board 14. The lower board 14 is a substantially rigid and hard board, having a substantially flat and slick bottom surface 16. Referring to FIG. 5, the lower board 14 has a perimeter 18. As seen in FIG. 2, the perimeter 18 is defined by a rising edge 19 which is curved upward from the bottom surface 16 and extends upward and outward from the bottom surface 16 to facilitate hydroplaning. The lower board 14 has a substantially flat top surface 20 to which the upper portion 12 is adhered using multiple layers of glue. The lower portion is preferably made of polyurethane and polyethylene foam which is coated with fiberglass and waterproof epoxy/resin; or of ABS/PVC plastic. Note that the rising edge meets the flat top surface 20 at an acute angle. This arrangement also minimizes any gap or discontinuity between the upper portion 12 and lower board 14 at the perimeter 18 which could cause injury, and facilitate loosening and separating of the upper portion 12 from the flat top surface 20 of the lower board 14 during repeated usage in salt water.

The upper portion 12 comprises a skin 22 which defines a chamber 24 which is capable of holding a volume of gas and is substantially sealed so that it is capable of maintaining an inflated state for an extended period of time. The skin 22 is preferably made of nylon urethane or PVC vinyl. The skin 22 is substantially soft and flexible, similar to materials used for other inflatable beach and bath toys and smaller recreational rafts. Like other inflatable devices, the chamber 24 may be a single chamber, or multiple chambers according to the desired configuration and design. The upper portion 12 has a top surface 12T, a bottom surface 12B, and side surfaces 12S. The upper portion has a central recess 26 which extends downward from the top surface 12T toward a central recess bottom 28. The central recess 26 accommodates the user and supports the weight of the user while riding the sliding toy 10 such that the user generally kneels or lays upon the central recess bottom 28. In the embodiment shown in FIG. 1 through 6, the central recess 26 is centered on the top surface 12T and surrounded by the top surface 12T. When inflated, the central recess bottom 28 is suspended a significant height above the lower board top surface 20, such that the central recess 26 is capable of supporting the weight of an intended user and supporting said user without deflecting significantly under the weight of said user such that said user hits against or contacts the top surface 20 of the lower board 14 during use of the toy 10. To facilitate this functionality, the central recess 26 may be reticulated with concentric ribs or pleated with multiple pleats—similar to the multiple longitudinal pleats found in many rectangular rafts—such that the central recess bottom 28 as defined herein actually comprises a top surface of such pleats which supports the user.

Figure 3:
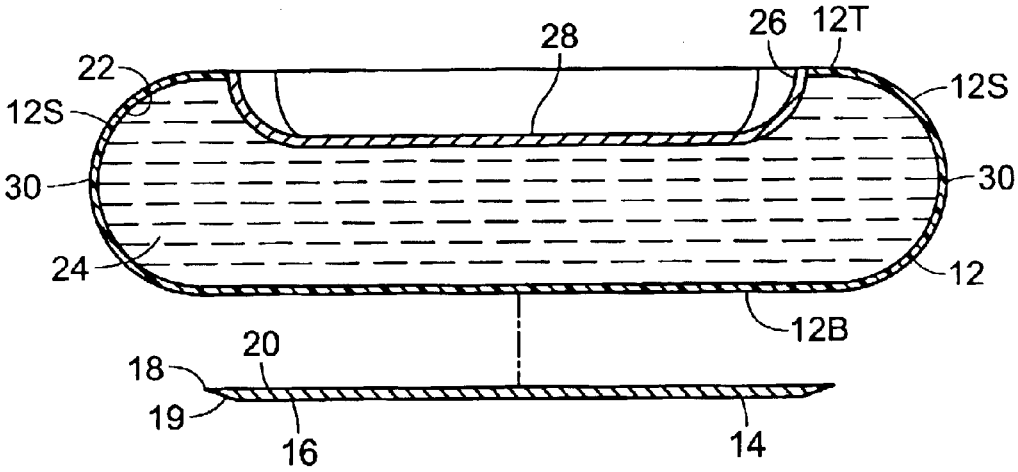
FIG. 3 is a cross sectional view illustrating the bipartite construction of the sliding toy, and the shallow central recess which provides additional cushioning to isolate the user from the rigid lower board.
Figure 4:
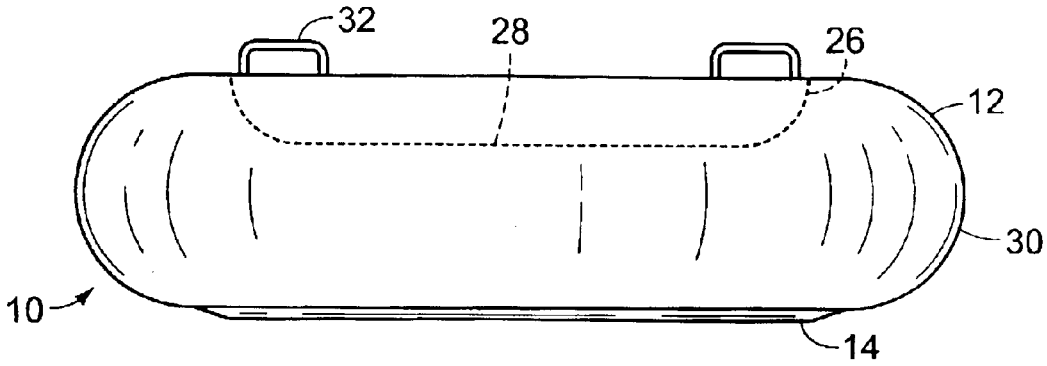
FIG. 4 is a side elevational view thereof.

Also illustrated in FIG. 3, the lower board 14 is sized so that once adhered to the upper portion 12, the upper portion extends laterally and overhangs well beyond the perimeter 18 of the lower board 14 in all horizontal directions, and thus "overhangs" the lower board 14. In this regard, the upper portion 12 has an outer edge 30 which bows outward, such that the upper portion 12 has a much larger footprint than the lower board 14, as seen by the bottom plan view of FIG. 5. When seen as a side elevation, as in FIG. 4, the lower board 14 is substantially hidden by the bulbous upper portion 12. Accordingly, when the sliding toy 10 is used, and is sliding horizontally across the water, any collision with another object or person will be with the outer portion 30 which acts as a bumper, redirecting the force of any impact as a momentary increase of air pressure against all interior surfaces of the chamber 24. With sufficient air pressure within the air chamber, the upper portion 12 will generally not sag below the bottom surface of the lower board 14 where it could interfere with the motion of the sliding toy 10.

For the sake of orientation, the sliding toy 10 can be considered to have a forward portion 12F and a rearward portion 12R. Two handles 32 are located on the upper portion 12 and are secured to the top surface 12T. Each handle 32 comprises a closed loop for accommodating one hand of a user, and is preferably made of PVC plastic tubes. The handles 32 are separated on the top surface 12T by substantially ninety degrees, deviating equally from a forward-rearward axis of the sliding toy 10, and are positioned near the forward portion 12F so as to facilitate the intended use of the sliding toy 10 whereupon the user runs while holding the toy 10 by the handles 32, and then dives onto ground at the shoreline, either laying across the top surface from the forward portion 12F to the rearward portion 10R or kneeling within the central recess 26. Also illustrated is an inflation valve 34 which selectively allows communication with the chamber 24 to allow inflation thereof, and selectively prevents air from escaping from the chamber 24.

Figure 6:
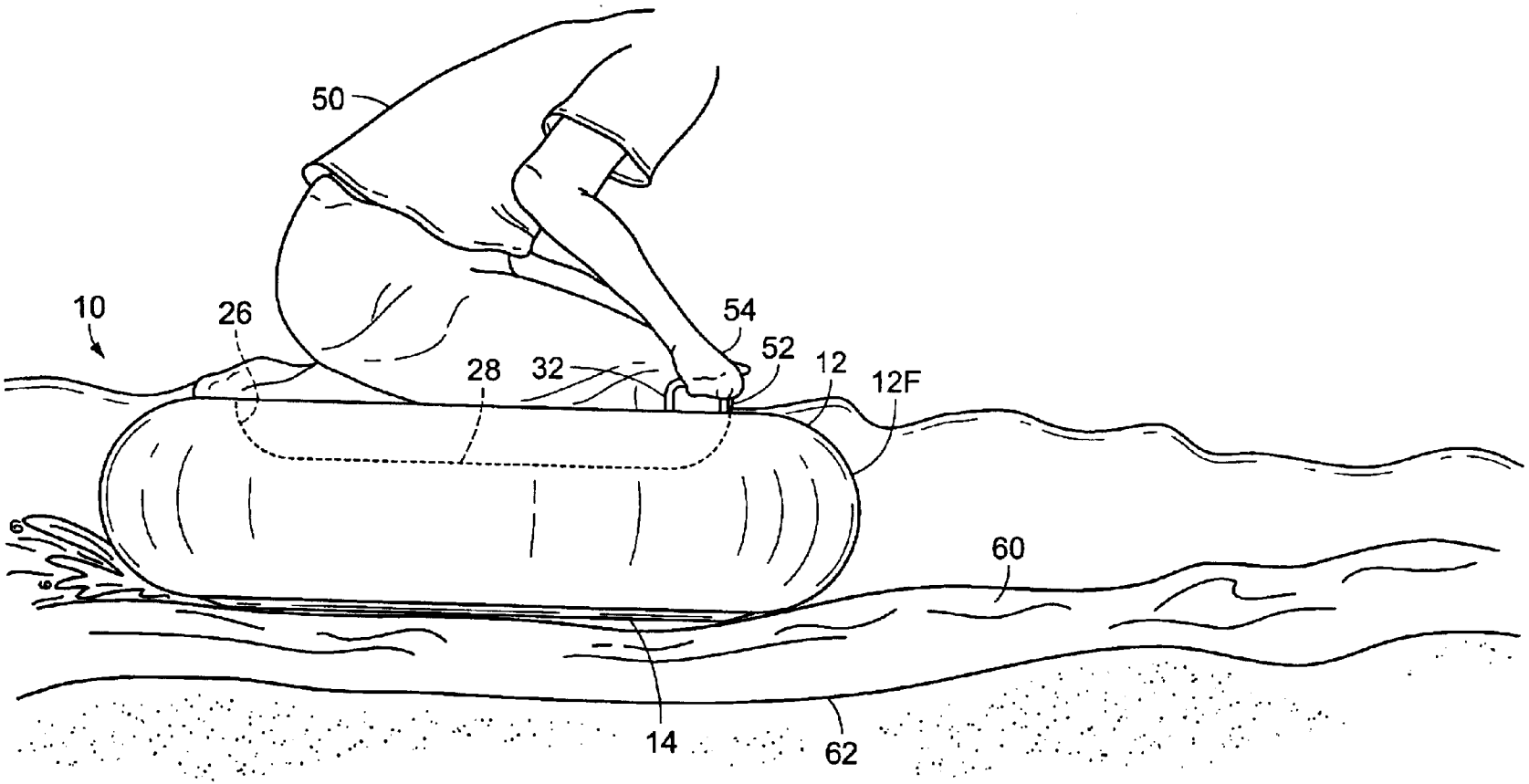
FIG. 6 is a side elevational view of the invention in use, wherein a user is kneeling within the central recess.

FIG. 6 illustrates the invention in use, wherein a user 50 is kneeling upon the central recess bottom 28 within the top surface 12T of the upper portion 12 and is riding upon a thin layer of water 60 found at the shoreline 62. Generally, the thin layer of water 60 is found where waves have broken as the water recedes. In particular, the user 50 has knees 52 which are resting within the central recess 26 and oriented toward the forward portion 12F. The user 50 also has hands 54 which are grasping the handles 32. The central recess 26 helps hold the user 50 onto the sliding toy 10 and supports the weight of the user 50. The user generally runs along the dry portion of the shoreline 62 while holding the handles 32 until sufficient speed and momentum is achieved. Then the user propels his/or her body onto the wet portion of the shoreline with the riding toy therebeneath, by diving or kneeling. With the proper momentum and a substantially forward trajectory, the user and sliding toy will hydroplane upon the wet shoreline for a considerable distance. The central recess bottom 28 suspends the user 50 well above the lower board 14 and thus maintains a comfortable ride for the user 50 while sliding along the shoreline 62.

The embodiment shown in FIGS. 1 through 6 is circular. Accordingly, in top and bottom plan, both the upper portion 12 is circular—similar to an automobile inner tube—and the bottom board 14 is circular yet smaller. However, a second embodiment of the sliding toy 10 is shown in FIG. 7 and FIG. 8, wherein the sliding toy 10 is substantially 'bullet shaped' in plan.

Figure 7:
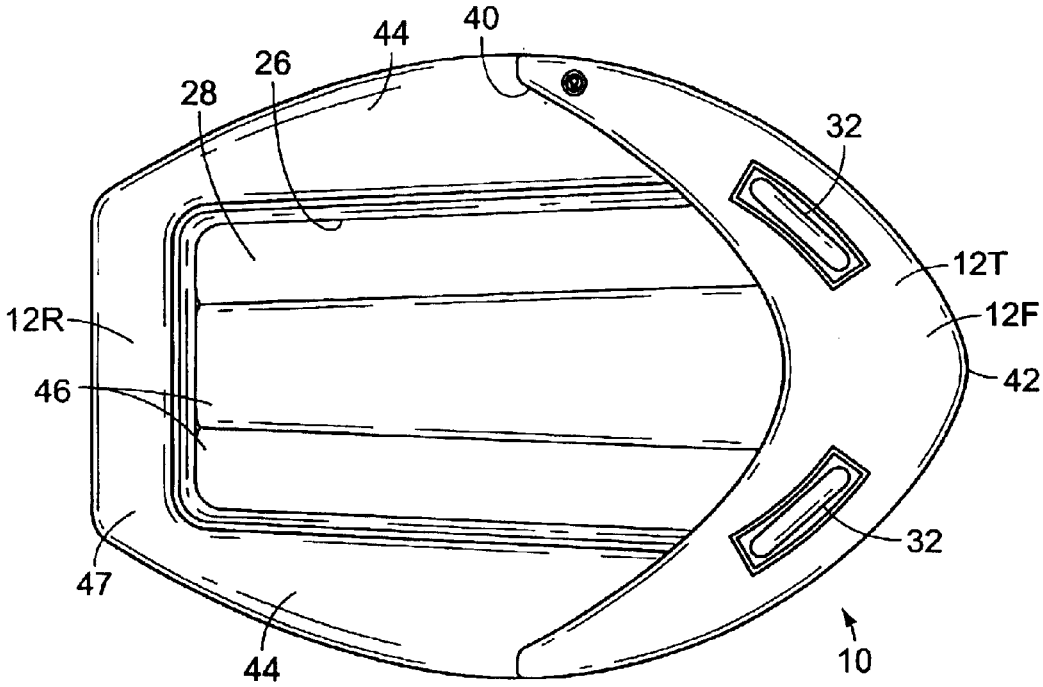
FIG. 7 is a top plan view, illustrating a second embodiment of the invention.
Figure 8:
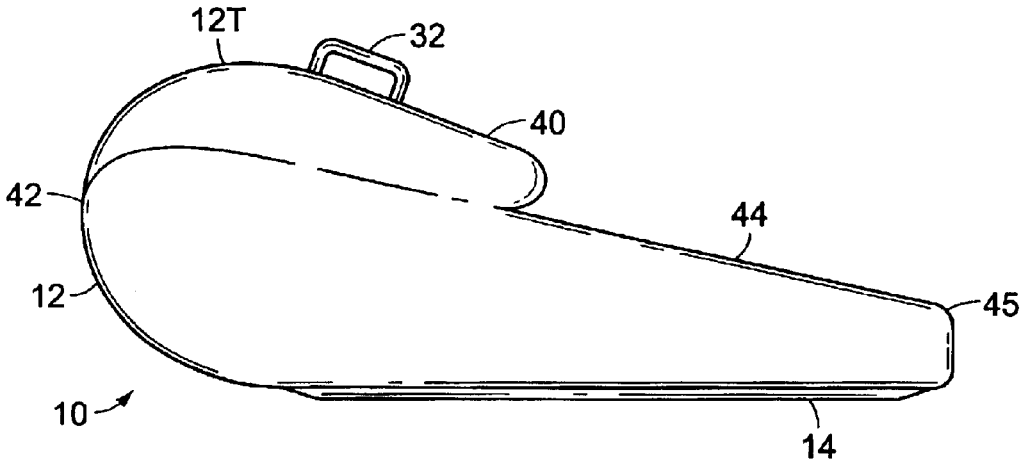
FIG. 8 is a side elevational view, illustrating the second embodiment of the invention.

FIG. 7 illustrates the second embodiment of the sliding toy 10, wherein the upper portion 12 of the toy is shaped to define a faring 40 having an apex 42 at the forward portion 12F. As in the previous embodiment, the top surface 12T still has the handles 32, which are located on the faring 40 on opposite sides of the apex 42 at the forward portion 12F. The faring 40 tapers downward toward the rear portion 12R. As seen in FIG. 8, at the rearward portion 12R the upper portion 12 extends at a back height 45 above the lower board 14. The back height 45 is still significant to maintain the comfort and safety of the user by suspending the user above the lower board 14.

As seen in FIG. 7 the upper portion 12 defines a pair of longitudinally extending side bolsters 44, and a rear bolster 47. The rear bolster 47 extends at the back height 45, and the side bolsters 44 taper downward from the faring 40 to the rear bolster 47. The central recess 26 extends between the side bolsters 44, the rear bolster 47 and the faring 40 at a substantially level height above the lower board 14 between the rear bolster 47 and the front faring 40. In particular, the central recess bottom 28 is shown as having multiple longitudinally extending pleats 46, which provide support to the user upon the central recess bottom 28 when riding upon the sliding toy.

In conclusion, herein is presented a shoreline sliding toy which allows a user to safely ride across the thin layer of water at the shoreline by providing a hybrid of a substantially rigid and slick lower board and a soft, inflatable upper portion which fully overhangs the lower board to provide safety to the user and others. The invention is illustrated by example in the foregoing description and in the drawing figures. Numerous variations are possible while adhering to the inventive concept. Such variations are contemplated as being a part of the present invention.

What is claimed is:

1. A sliding toy, for allowing a user to slide across a thin layer of water at a shoreline, comprising:

a lower board, the lower board rigid and hard, having a substantially flat bottom surface which is slick, and a substantially flat top surface, the lower board having a perimeter having a rising edge;

an upper portion, the upper portion made of a soft, flexible skin defining an inflatable chamber, the upper portion having a top surface, a central recess extending downward from the top surface and having a central recess bottom for accommodating the user and suspending the user above the lower board, and a bottom surface which is attached to the lower board top surface, the upper portion extends laterally outward beyond the perimeter of the lower board in all horizontal directions such that the footprint of the upper portion is substantially larger than the footprint of the lower board and the upper portion fully covers the lower board so that the user only contacts the upper portion when riding upon the upper portion and so that if the sliding toy collides with an object while sliding horizontally the object will strike the upper portion.

2. The sliding toy as recited in claim 1, further comprising a pair of handles which are secured to the top surface.

3. The sliding toy as recited in claim 2, wherein the sliding toy has a forward portion and a rearward portion, and wherein both handles are located on the top surface near the forward portion.

4. The sliding toy as recited in claim 3, wherein the rising edge of the lower board is curved upward from the bottom surface of the lower board, wherein the rising edge meets the upper portion at an acute angle.

5. The sliding toy as recited in claim 4, wherein the upper portion has a faring located at the forward portion, a rear bolster located at the rearward portion, and a pair of side bolsters extending between the forward bolster and rear bolster, the forward portion having an apex fully forward thereon the faring tapering downward rearward from the apex, the central recess located between the faring, the side bolsters and rear bolster, and wherein the pair of handles are secured atop the faring.

6. A sliding toy, for allowing a user to slide across a thin layer of water at a shoreline, comprising:

a lower board, the lower board rigid and hard, made of a material selected from fiberglass covered foam and plastic, the lower board having a substantially flat bottom surface which is slick, and a substantially flat top surface, the lower board having a perimeter;

an upper portion, the upper portion made of a soft, flexible skin defining an inflatable chamber, the upper portion having a bottom surface which is attached to the lower board top surface, the upper portion extends laterally outward beyond the perimeter of the lower board in all horizontal directions such that the footprint of the upper portion is substantially larger than the footprint of the lower board and the upper portion fully covers the lower board so that the user only contacts the upper portion when riding upon the upper portion and so that if the sliding toy collides with an object while sliding horizontally the object will strike the upper portion.

7. The sliding toy as recited in claim 6, wherein the upper portion has a top surface, and further comprising a pair of handles which are secured to the top surface.

8. The sliding toy as recited in claim 7, wherein the sliding toy has a forward portion and a rearward portion, and wherein both handles are located on the top surface near the forward portion.

9. The sliding toy as recited in claim 8, wherein the upper portion comprises a central recess which extends downward from the top surface, the central recess having a central recess bottom for accommodating the user and suspending the user above the lower board.

10. The sliding toy as recited in claim 9, wherein the lower board has a perimeter having a rising edge, the rising edge is curved upward from the lower board, wherein the rising edge meets the upper portion at an acute angle.

11. The sliding toy as recited in claim 10, wherein the upper portion has a faring located at the forward portion, a rear bolster located at the rearward portion, and a pair of side bolsters extending between the forward bolster and rear bolster, the forward portion having an apex fully forward thereon the faring tapering downward rearward from the apex, the central recess located between the faring, the side bolsters and rear bolster, and wherein the handles are secured atop the faring.

* * * * *